US006412649B1

(12) United States Patent
Khachaturian

(10) Patent No.: US 6,412,649 B1
(45) Date of Patent: Jul. 2, 2002

(54) SPREADER BAR APPARATUS

(76) Inventor: Jon E. Khachaturian, 5427 Sutton Pl., New Orleans, LA (US) 70131

( * ) Notice: Subject to any disclaimer, the term of this patent is extended or adjusted under 35 U.S.C. 154(b) by 0 days.

(21) Appl. No.: 09/499,483

(22) Filed: Feb. 7, 2000

(51) Int. Cl.[7] ..... B66C 1/12

(52) U.S. Cl. ..... 212/242; 212/271; 294/81.3; 294/81.5; 294/74

(58) Field of Search ..... 212/242, 251, 212/259, 270, 271; 294/81.1, 81.2, 81.21, 81.3, 81.4, 81.5, 81.6, 74, 81.54, 81.62

(56) References Cited

U.S. PATENT DOCUMENTS

| | | | | | |
|---|---|---|---|---|---|
| 2,842,819 | A | * | 7/1958 | Granath | 294/81.4 |
| 3,210,114 | A | * | 10/1965 | Lawton | 294/81.5 |
| 3,252,729 | A | * | 5/1966 | Holmes | 294/74 |
| 3,519,303 | A | * | 7/1970 | Gille | 294/81.1 |
| 3,558,173 | A | * | 1/1971 | Palm | 294/81.1 |
| 3,831,993 | A | * | 8/1974 | Drayton et al. | 294/81.1 |
| 4,353,471 | A | * | 10/1982 | Palmer | 212/259 |
| 4,397,493 | A | | 8/1983 | Khachaturian | 294/81 |
| 4,538,849 | A | | 9/1985 | Khachaturian | 294/81.1 |
| 4,565,399 | A | * | 1/1986 | Cranston | 294/74 |
| 4,838,522 | A | * | 6/1989 | Calkins | 212/259 |
| 5,342,104 | A | * | 8/1994 | Sato et al. | 294/81.21 |
| 5,603,544 | A | * | 2/1997 | Bishop et al. | 294/81.1 |
| 5,716,088 | A | * | 2/1998 | Chander et al. | 294/81.1 |
| 5,863,085 | A | | 1/1999 | Khachaturian | 294/81.1 |
| 6,079,760 | A | * | 6/2000 | Khachaturian | 294/81.1 |

FOREIGN PATENT DOCUMENTS

| | | | | |
|---|---|---|---|---|
| DE | 0252176 | * | 12/1987 | 294/81.4 |
| JP | 1172194 | * | 7/1989 | 294/74 |
| SU | 0812691 | * | 3/1981 | 294/81.1 |

* cited by examiner

*Primary Examiner*—Dean J. Kramer
*Assistant Examiner*—Paul T. Chin
(74) *Attorney, Agent, or Firm*—Garvey, Smith, Nehrbass & Doody, LLC; Gregory C. Smith

(57) ABSTRACT

A spreader bar includes an elongated bar member having end portions that support a flexible lifting member that is supported below the bar. The flexible lifting member is preferably comprised of a plurality of link sections that are pinned together, load carrying links depending from the flexible member, preferably at pinned connections that join the additional links.

25 Claims, 5 Drawing Sheets

SPREADER BAR APPARATUS

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to lifting apparatus and accessories, and more particularly to an improved spreader bar lifting apparatus for use with cranes and other lifting devices that use slings. Even more particularly the present invention relates to an improved spreader bar arrangement that includes a main beam or bar that supports a flexible member preferably comprised of a plurality of links or sections, and wherein the links or sections have connectors that enable connections to be made between the links and a load to be lifted or load lines (eg. slings).

2. General Background of the Invention

Spreader bars are commonly used in industry for lifting large objects with a single hook that is attached to the crown block and lift cables of a crane. A lifting hook is commonly provided with a pair of slings that depend from the crane hook at angles in a bridle fashion, each of the slings connecting to an end portion of the spreader bar. Parallel, depending lift lines are then suspended from the end portions of the spreader bar downwardly to the load that is to be lifted.

One of the problems with spreader bars is that of sizing the spreader bar to meet a particular load. Loads typically differ in size and in configuration. Some devices have been patented that enable the overall length of the bar to be changed by changing the center section to which a pair of end caps attach. An example of such as a spreader bar that has been patented can be seen in my prior U.S. Pat. No. 4,397,493, and entitled "Spreader Bar Assembly". Other spreader bar patents include U.S. Pat. Nos. 4,538,849 and 5,863,085, each incorporated herein by reference.

In some situations, a user has a pair of cranes or like lifting devices such as for example a ship having two cranes positioned at opposite ends of an opening in the hull above a hold or other cargo area. This presents a problem to the ship operator when very heavy loads of differing configurations are to be lifted out of the cargo area. Sometimes the position of the load in the cargo area requires that a crane be positioned at such an angle of inclination that the lifting capacity of the boom is at its lowest portion of its range.

BRIEF SUMMARY OF THE INVENTION

The present invention provides an improved spreader bar apparatus that includes a pair of bar sections. The present invention provides an improved spreader bar apparatus that includes a bar or beam member having first and second end portions. Each of the end portions provides a lifting portion that can be attached to a lifting device such as a crane. A flexible member is supported by each of the bar members at the lifting portions, the flexible member preferably extending in a curved fashion below the bar and in between the two bar ends.

The flexible member provides attachments at spaced apart intervals along the flexible member, each of the attachments being a location that can support a lifting line, sling or the like.

The flexible member is preferably comprised of a plurality of links connected together end to end.

The flexible member can be comprised of a plurality of links that are pinned together.

The flexible member can be comprised of a plurality of plate members, each plate member being an elongated structure having end portions, wherein one end portion of one plate member is connected to an end portion of another plate member, preferably using a pinned connection. At that pinned connection, a third plate member can be positioned to extend downwardly from the pinned connection and assume a generally vertical position. This third plate member functions as a load carrying member to which a depending lift line, sling or the like can be attached (for example, using shackles).

The plurality of plate members thus includes a first plurality of laterally extending plate members and a second plurality of vertically extending plate members. In one embodiment, the apparatus includes two separate lifting cranes positioned at spaced apart locations, each of the lifting cranes supporting a separate end of the bar.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
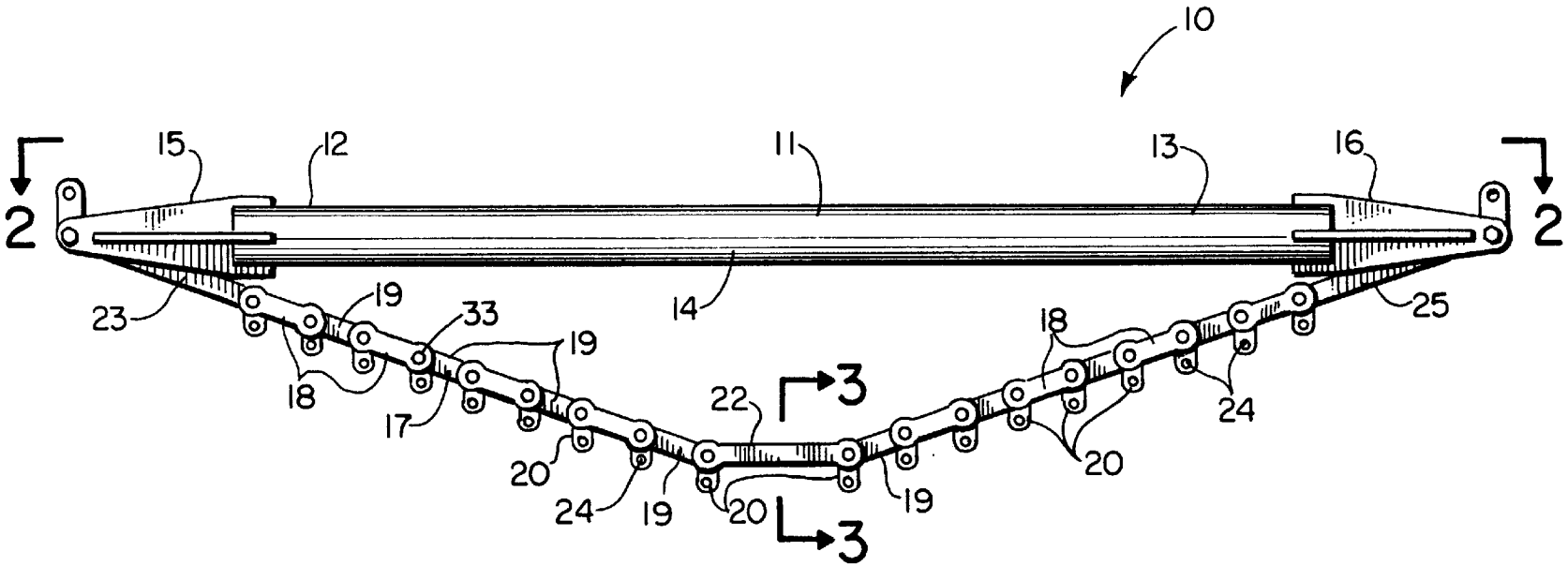
FIG. 1 is a front, elevational view of the preferred embodiment of the apparatus of the present invention.

FIGS. 1, 2, 5 and 6 show the preferred embodiment of the apparatus of the present invention, designated generally by the numeral 10. Spreader bar apparatus 10 is comprised generally of an elongated bar 11 having end portions 12, 13 and center portion 14.

Ends 15, 16 are fitted to the bar 11 for example, using welding.

The bar 11 can be an elongated, cylindrically shaped member, such as a section of pipe. The bar 11 can be hollow or solid. The ends 15, 16 are connected, preferably by welding, to the end portions 12, 13 of bar 11. End 15 is welded to bar 11 at end portion 12. End 16 is welded to bar 11 at end portion 13. If removable connections between bar 11 and end 15, 16 are desired, the ends 15, 16 can be constructed to be removable and not welded such as those shown in the Jon Khachaturian patent 4,397,493, incorporated herein by reference.

Figure 3:
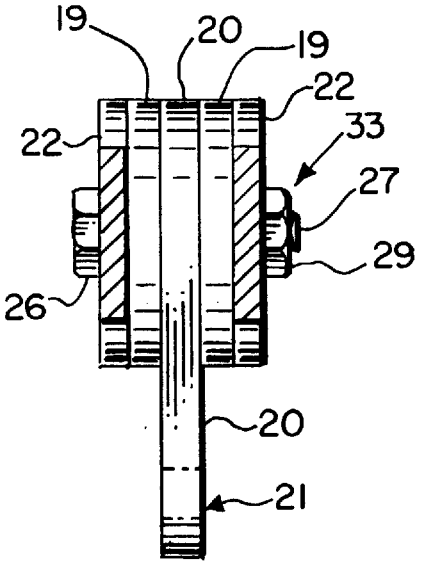
FIG. 3 is a sectional view of the preferred embodiment of the apparatus of the present invention taken along lines 3—3 of FIG. 1.
Figure 4:
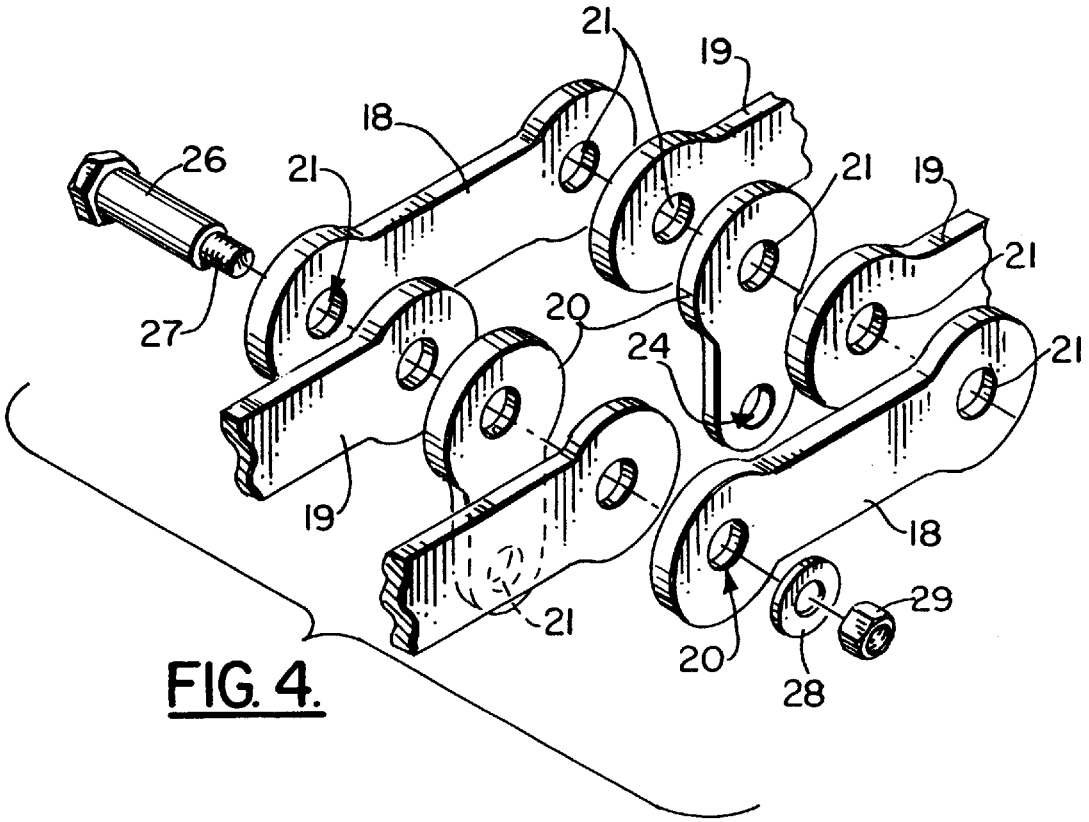
FIG. 4 is a partial, perspective view of the preferred embodiment of the apparatus of the present invention.

The combination of bar 11 and its ends 15, 16, support an elongated flexible member 17 that can be comprised of a plurality of links 18, 19, 20, 22, 23, 25. In FIGS. 1, 3, 4, and 7, the flexible member 17 is shown comprised of a plurality of links connected together and preferably using a pinned connection at adjacent links such as the pinned connection 33 shown in the drawings. Each pinned connection 33 can be comprised of pin 26 having threaded portion 27, washer 28 and nut 29 as shown in FIG. 4.

Figure 7:
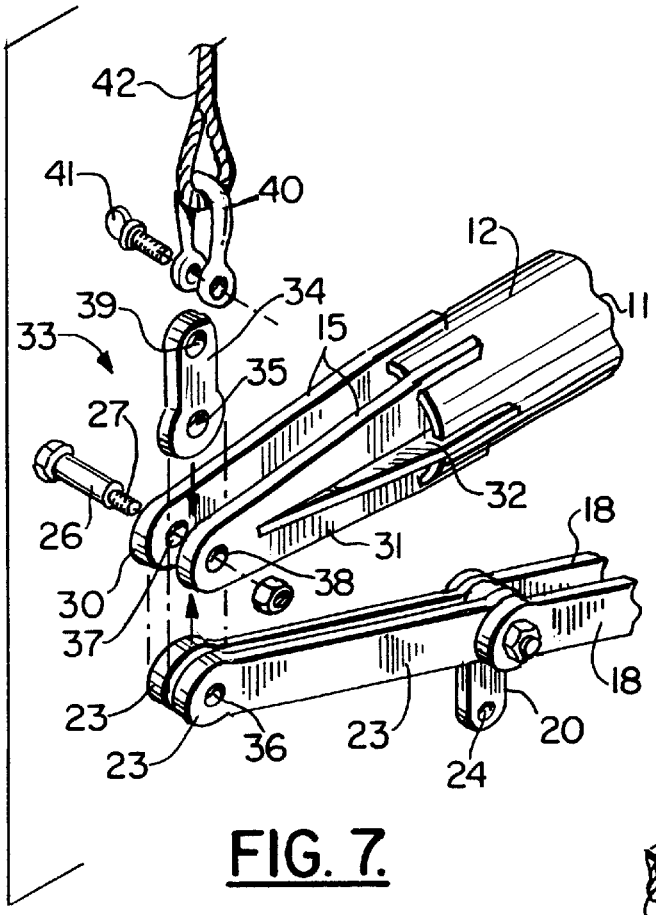
FIG. 7 is a partial, exploded perspective view of the preferred embodiment of the apparatus of the present invention.

In FIG. 4, outside links 18 form attachments to inside links 19 and lifting link 20. The outside plate line 18 and inside plate link 19 are laterally extending as shown in FIGS. 1 and 4. The lifting link 20 is generally vertically extended (or nearly vertically extended) as shown by FIGS. 1 and 4. Each of the links 18, 19, 22, 23 and 25 have a pair of openings 21. These openings 21 are at the end portions of each of the links 18, 19, 22, 23, 25 as shown in FIGS. 4 and 7. Link 20 has an upper 35 opening 21 and a lower opening 24. Large, horizontally extended links 22 define center links for the flexible member 17 as shown in Figure 1. At this center position, there are preferably two large horizontal links 22 as shown in FIG. 3.

Figure 2:
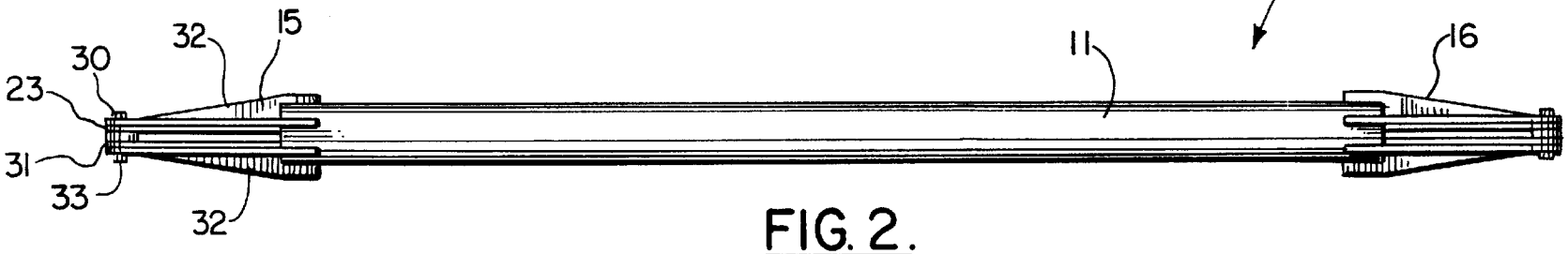
FIG. 2 is a top, plan view of the preferred embodiment of the preferred embodiment of the apparatus of the present invention taken along lines 2—2 of FIG. 1.

Each bar end 15, 16 has a pinned connection 33 as shown in FIG. 7 that forms an attachment between an end 15 or 16 and diagonally extending links 23. In FIG. 7, each end 15 or 16 is comprised preferably of a pair of spaced apart plates 30, 31 each being welded to end portion 12 or 13 of bar 11. Alternatively, the plates 30, 31 can be welded to the cylindrically shaped socket portion of a removable end cap that fits each end portion 12, 13 of bar 11. Stiffener plates 32 can be provided as shown in FIGS. 2 and 7 for forming an attachment between each of the plates 30 and 31 and bar 11.

The stiffeners 32 can be welded to the respective plates 30 or 31 and also are welded to the end portion 12 or 13 of bar 11. An additional link 34 forms a part of the connection that is pinned using pin connection 33 at each end 15 or 16. As shown in FIG. 7, this additional link is a vertically extending lifting link 34 having an opening 35 that aligns with the openings 36 in diagonally positioned links 23 or 25 and the openings 37, 38 in plates 30, 31 respectively of end 15. The lifting link 34 also has an opening 39 that enables a connection to be formed with a lifting member or connecting member such as shackle 40, shackle pin 41 and lifting sling (vertical or inclined) 42.

Figure 8:
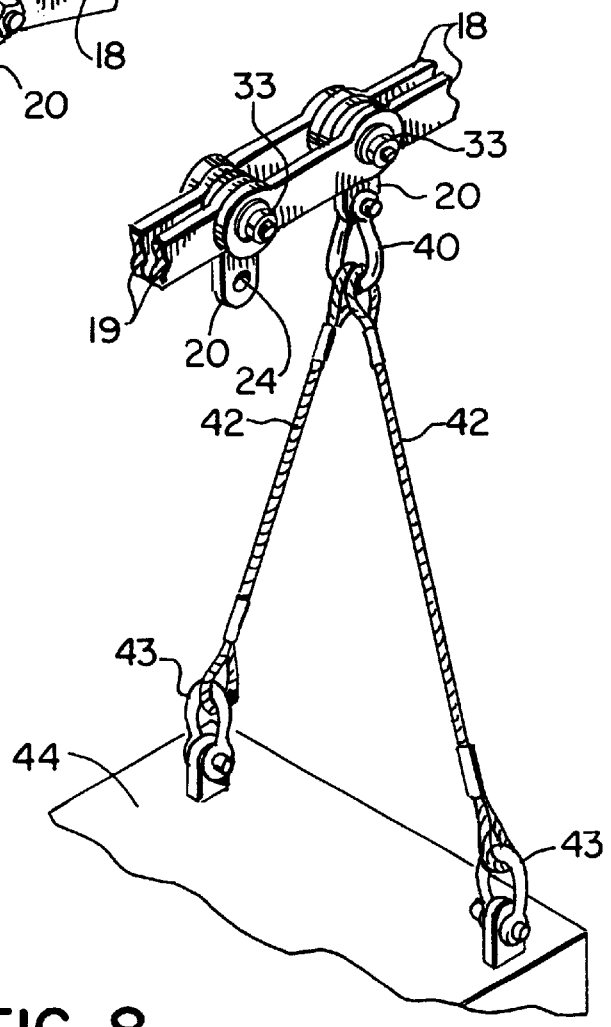
FIG. 8 is a partial perspective view of the preferred embodiment of the apparatus of the present invention illustrating a connection be ween the spreader bar and a load using lifting slings and shackles.

Shackles 40 can also be used to form an attachment between one of the lifting links 20 that depends from links 18, 19 of flexible member 17 as shown in FIG. 8. Slings 42 can then be connected between the shackle 40 that is attached to a link 20 and shackles 43 attached to load 44.

Figure 5:
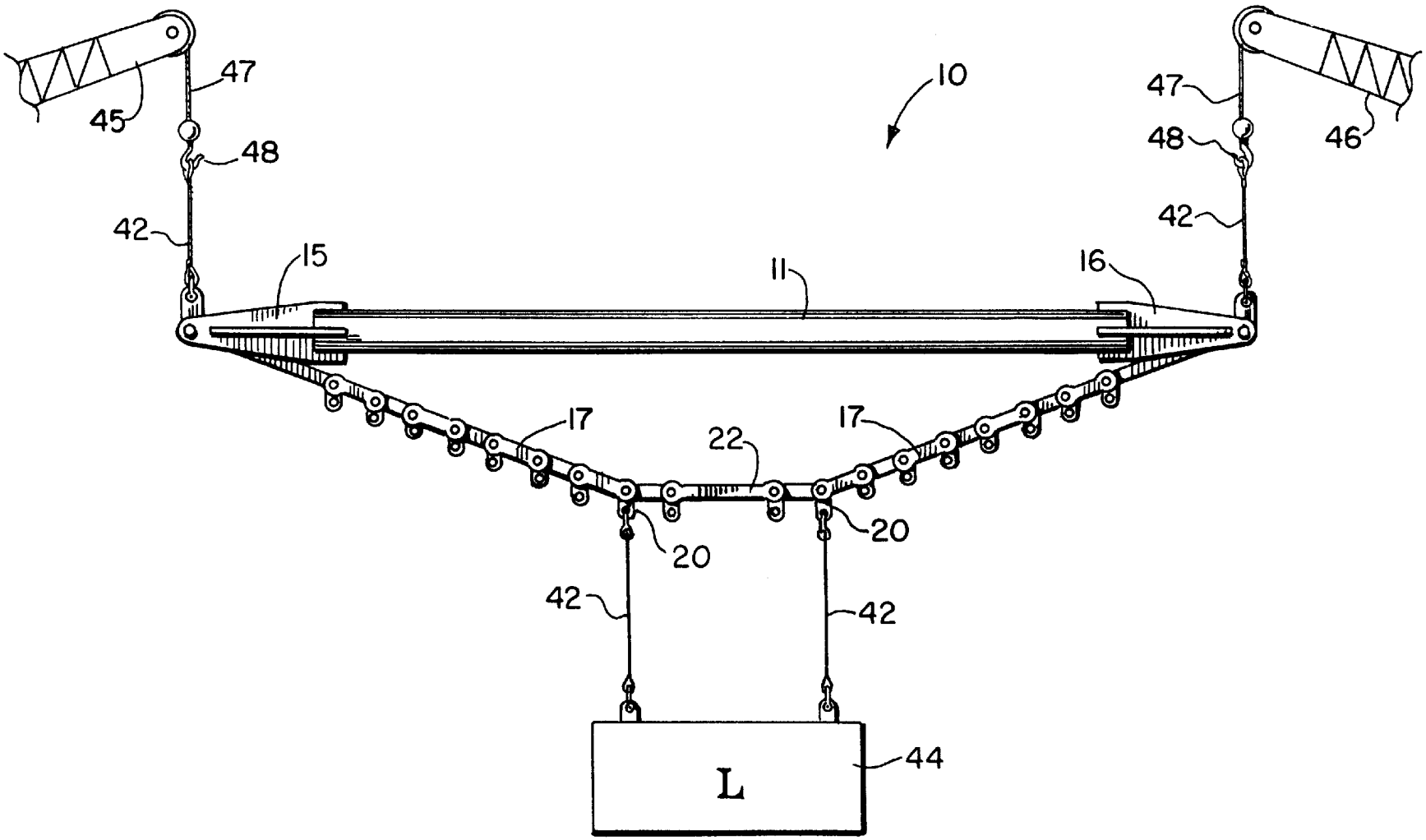
FIG. 5 is a front elevational view of the preferred embodiment of the apparatus of the present invention shown during use.
Figure 6:
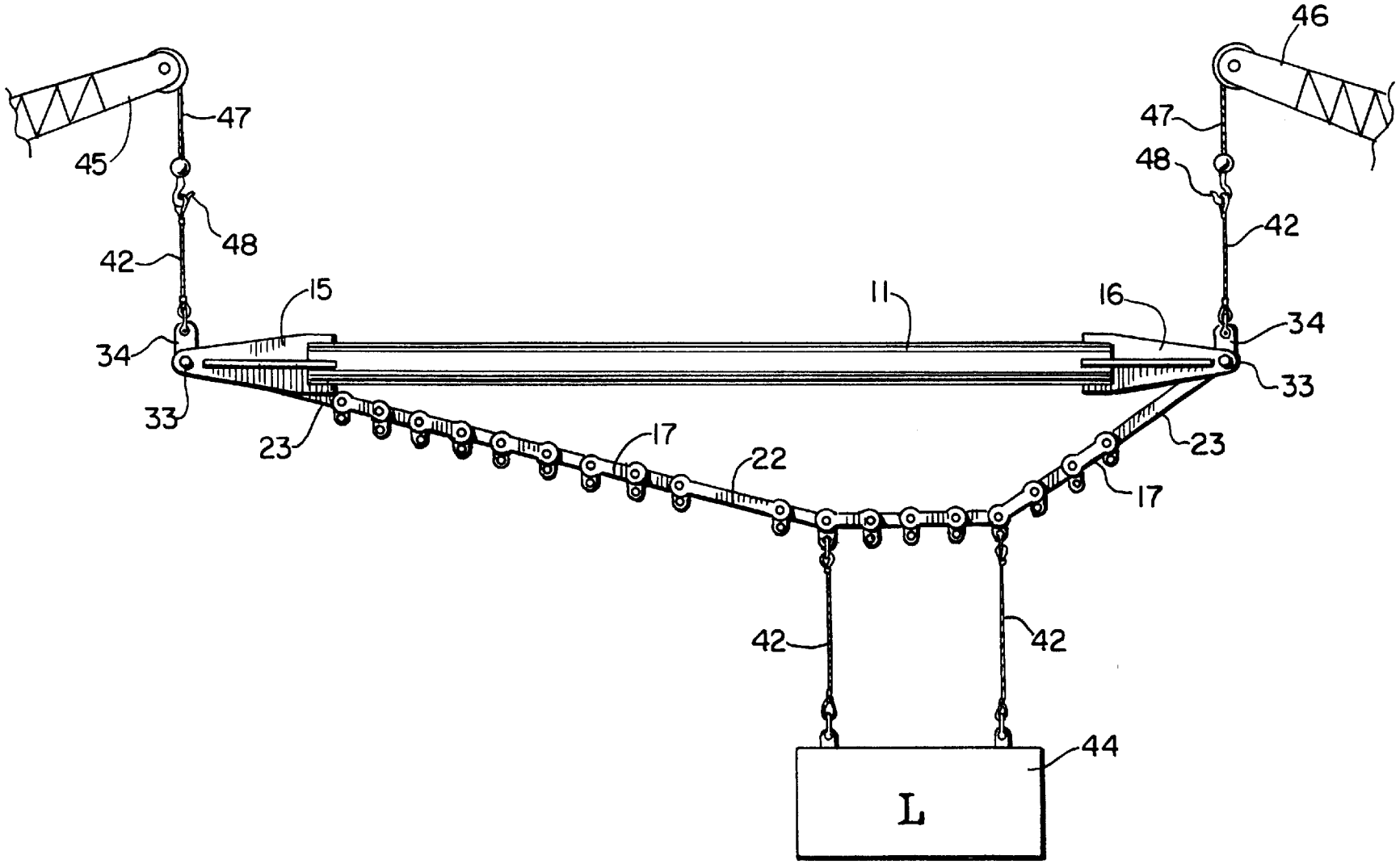
FIG. 6 is another front, elevational view of the preferred embodiment of the apparatus of the present invention shown during use.

FIGS. 5 and 6 illustrate a completed rigging wherein spreader bar 10 forms an interface between the load 44 to be lifted and a lifting device (or devices) such as cranes 45, 46. Each of the cranes 45, 46 provides a lifting line 47 and a hook 48 for engaging and supporting slings 42.

In FIG. 5, the load 44 has been "centered", being connected to flexible member 17 with slings 42 that are at equal distances from large, horizontal center link 22. In FIG. 6, an offset loading arrangement is illustrated. In FIG. 6, the slings 42 are connected to links 20 that are to the right of the center, large horizontal link 22. Such a situation might occur depending upon the load 44 to be lifted, the initial position of the load 44 (such as its location in the hold of a ship) or the position of equipment that is near or surrounding the load 44 to be lifted.

PARTS LIST

| Part Number | Description |
|---|---|
| 10 | spreader bar apparatus |
| 11 | bar |
| 12 | end portion |
| 13 | end portion |
| 14 | center portion |
| 15 | end |
| 16 | end |
| 17 | flexible member |
| 18 | outside plate link |
| 19 | inside plate link |
| 20 | lifting link |
| 21 | opening |
| 22 | large horizontal link |
| 23 | diagonally positioned link |
| 24 | opening |
| 25 | diagonally positioned link |
| 26 | pin |
| 27 | threaded portion |
| 28 | washer |
| 29 | nut |
| 30 | plate |
| 31 | plate |
| 32 | stiffener plate |
| 33 | pinned connection |
| 34 | lifting link |
| 35 | opening |
| 36 | opening |
| 37 | opening |
| 38 | opening |
| 39 | opening |
| 40 | shackle |
| 41 | shackle pin |
| 42 | sling |
| 43 | shackle |
| 44 | load |
| 45 | crane |
| 46 | crane |
| 47 | lifting line |
| 48 | crane hook |

The foregoing embodiments are presented by way of example only; the scope of the present invention is to be limited only by the following claims.

What is claimed is:

1. A spreader bar apparatus, comprising:

a) a bar member having a bar length and first and second end portions;

b) the first end portion having a first bar end with a lifting portion;

c) the second end portion having a second bar end with a lifting portion;

d) a flexible member having end portions and a central portion and a length that approaches the bar length, and being supported by the bar member at a position next to the bar lifting portions, the flexible member being spaced farther from the bar at its central portion than at its end portions;

e) attachments at spaced apart intervals along the flexible member;

f) a lifting line that is attachable to the flexible member at a selected one of the attachments on the flexible member; and g) wherein the flexible member is comprised of a plurality of separate elements that are connected together at locations next to said attachments wherein the flexible member is comprised of a plurality of links that are pinned together.

2. A spreader bar apparatus, comprising:

a) a bar member having first and second end portions;

b) the first end portion having a first bar end with a lifting portion;

c) the second end portion having a second bar end with a lifting portion;

d) a flexible member supported by the bar member at the lifting portions;

e) attachments at spaced apart intervals along the flexible member;

f) a lifting line that is attachable to the flexible member at a selected one of the attachments on the flexible member;

g) wherein the flexible member is comprised of a plurality of separate elements that are connected together at locations next to said attachments; and h) wherein the flexible member is comprised of a plurality of plate Members, each having end portions, an end portion of one plate member being connected to an end portion of another plate member.

3. A spreader bar apparatus, comprising:

a) a bar member having first and second end portions;

b) the first end portion having a first bar end with a lifting portion;

c) the second end portion having a second bar end with a lifting portion;

d) a flexible member supported by the bar member at the lifting portions;

e) attachments at spaced apart intervals along the flexible member;

f) a lifting line that is attachable to the flexible member at a selected one of the attachments on the flexible member; and g) wherein the flexible member is comprised of a plurality of separate elements that are connected together at locations next to said attachments;

h) wherein the flexible member is comprised of a plurality of plate members including a first plurality of laterally extending plate members and a second plurality of vertically extending plate members.

4. The spreader bar apparatus of claim 3 wherein the vertically extending plate members define said attachments.

5. The spreader bar apparatus of claim 4 wherein a common pinned connection joins a plurality of laterally extending plate members and a vertically extending plate member.

6. The spreader bar apparatus of claim 5 wherein the vertically extending link member has an opening that defines one of said attachments.

7. The spreader bar apparatus of claim 3 further comprising two separate lifting cranes for supporting tile respective bar ends at the lifting ends.

8. A spreader bar apparatus, comprising:

a) a bar member having first and second end portions;

b) the first end portion having a first bar end with a lifting portion;

c) the second end portion having a second bar end with a lifting portion;

d) a flexible member supported by the bar member only at the bar end portions;

e) sling attachments at spaced apart intervals along the flexible member;

f) a plurality of slings that are attachable to the flexible member at a selected one of the sling attachments on the flexible member; and g) wherein the flexible member is comprised of a plurality of separate elements that are connected together wherein the flexible member is comprised of a plurality of links that are pinned together.

9. The spreader bar apparatus of claim 8 further comprising two separate lifting cranes for supporting the respective bar ends at the lifting ends.

10. A spreader bar apparatus, comprising:

a) a bar member having first and second end portions;

b) the first end portion having a first bar end with a lifting portion;

c) the second end portion having a second bar end with a lifting portion;

d) a flexible member supported by the bar member at the bar ends;

e) sling attachments at spaced apart intervals along the flexible member;

f) a plurality of slings that are attachable to the flexible member at a selected one of the sling attachments on the flexible member;

g) wherein the flexible member is comprised of a plurality of separate elements that are connected together; and h) wherein the flexible member is comprised of a plurality of plate members, each having end portions, an end portion of one plate member being connected to an end portion of another plate member.

11. A spreader bar apparatus, comprising:

a) a bar member having first and second end portions;

b) the first end portion having a first bar end with a lifting portion;

c) the second end portion having a second bar end with a lifting portion;

d) a flexible member supported by the bar member at the bar ends;

e) sling attachments at spaced apart intervals along the flexible member;

f) a plurality of slings that are attachable to the flexible member at a selected one of the sling attachments on the flexible member;

g) wherein the flexible member is comprised of a plurality of separate elements that are connected together; and h) wherein the flexible member is comprised of a plurality of plate members including a first plurality of laterally extending plate members and a second plurality of vertically extending link members.

12. The spreader bar apparatus of claim 11 wherein the vertically extending link members define said attachments.

13. The spreader bar apparatus of claim 12 wherein a common pinned connection joins a plurality of laterally extending link members and a vertically extending link member.

14. The spreader bar apparatus of claim 13 wherein the vertically extending link member has an opening that defines one of said attachments.

15. A spreader bar apparatus, comprising:

a) a pair of lifting cranes;

b) a bar member having first and second end portions;

c) the first end portion having a first bar end removably attached to a first of the cranes;

d) the second end portion having a second bar end removably attached to a second of the cranes;

e) a flexible member supported by the bar member at the lifting portions, wherein the flexible member is comprised of a plurality of separate plates that are connected together end-to-end, a plate being connected to the plate next to it at a pinned connection;

f) each pinned connection supporting a depending plate;

g) a plurality of lifting lines that are attachable to selected depending plates.

16. The spreader bar apparatus of claim 15 wherein the plurality of elements connected together end to end are about the same size.

17. The spreader bar apparatus of claim 15 wherein an end portion of one plate member is connected to an end portion of another plate member.

18. The spreader bar apparatus of claim 15 wherein the flexible member is comprised of a plurality of plate members including a first plurality of laterally extending plate members and a second plurality of vertically extending plate members.

19. The spreader bar apparatus of claim 18 wherein the vertically extending plate members define said attachments.

20. The spreader bar apparatus of claim 18 wherein a common pinned connection joins a plurality of laterally extending plate members and a vertically extending plate member.

21. The spreader bar apparatus of claim 18 wherein the vertically extending link member has an opening that defines one of said attachments.

22. A spreader bar apparatus, comprising:

a) a pair of lifting cranes;, b) a bar member having first and second lifting end of portions;

c) the first end portion having a first bar end removably attached to a first of the cranes;

d) the second end portion having a second bar end removably attached to a second of the cranes;

e) a flexible member having end portions and a central portion and being supported by the bar member at a position next to the lifting portions, the flexible member being spaced farther from the bar at its central portion than at its end portions;

f) attachments at spaced apart intervals along the flexible member;

g) a lifting line that is attachable to the flexible member at a selected one of the attachments on the flexible member; and h) wherein the flexible member is comprised of a plurality of separate elements that are connected together at locations next to said attachments wherein the flexible member is comprised of a plurality of plate members defining said elements including a first plurality of laterally extending plate members and a second plurality of vertically extending plate members.

23. The spreader bar apparatus of claim 22 wherein the vertically extending plate members define said attachments.

24. The spreader bar apparatus of claim 22 wherein a common pinned connection joins a plurality of the laterally extending plate members and a vertically extending plate member.

25. The spreader bar apparatus of claim 24 wherein the vertically extending link member has an opening that defines one of said attachments.

* * * * *